US010004939B1

(12) United States Patent
McKinley

(10) Patent No.: US 10,004,939 B1
(45) Date of Patent: Jun. 26, 2018

(54) WHEEL ATTACHMENT FOR STATIONARY EXERCISE BIKE

(71) Applicant: Timothy McKinley, Orem, UT (US)

(72) Inventor: Timothy McKinley, Orem, UT (US)

( * ) Notice: Subject to any disclaimer, the term of this patent is extended or adjusted under 35 U.S.C. 154(b) by 183 days.

(21) Appl. No.: 15/175,236

(22) Filed: Jun. 7, 2016

(51) Int. Cl.

| | |
|---|---|
| ***A63B 22/12*** | (2006.01) |
| ***A63B 22/00*** | (2006.01) |
| ***A63B 21/00*** | (2006.01) |
| ***A63B 21/015*** | (2006.01) |
| ***A63B 21/06*** | (2006.01) |
| ***A63B 22/06*** | (2006.01) |
| ***A63B 23/035*** | (2006.01) |

(52) U.S. Cl.
CPC .... *A63B 22/0012* (2013.01); *A63B 21/00192* (2013.01); *A63B 21/015* (2013.01); *A63B 21/0618* (2013.01); *A63B 21/4034* (2015.10); *A63B 21/4035* (2015.10); *A63B 22/0605* (2013.01); *A63B 23/03575* (2013.01); *A63B 2022/0635* (2013.01)

(58) Field of Classification Search
CPC ..... A63B 22/0605; A63B 21/0051; A63B 21/015; A63B 21/00069; A63B 2225/09; A63B 2225/093; A63B 21/225; A63B 2071/0081; A63B 21/023; A63B 22/0012
See application file for complete search history.

(56) References Cited

U.S. PATENT DOCUMENTS 3,953,025 A * 4/1976 Mazman ..... A63B 21/015 482/118
4,007,927 A * 2/1977 Proctor ..... A63B 21/015 482/63
4,082,265 A * 4/1978 Berkes ..... A63B 22/16 280/293
4,364,557 A * 12/1982 Serati ..... A63B 71/06 482/65
4,408,613 A * 10/1983 Relyea ..... A61B 5/222 482/5
4,417,724 A * 11/1983 Bikker ..... A63B 21/015 188/251 A
4,595,198 A * 6/1986 Sparks ..... A63B 21/015 188/184
4,673,177 A * 6/1987 Szymski ..... A63B 21/015 482/119
4,817,939 A * 4/1989 Augspurger ..... A63B 22/16 482/2
5,031,901 A * 7/1991 Saarinen ..... A63B 21/0051 310/191

(Continued)

*Primary Examiner* — Garrett Atkinson
(74) *Attorney, Agent, or Firm* — Kyle A. Fletcher, Esq.

(57) ABSTRACT

The wheel attachment for stationary exercise bike is an attachment adapted for use with a stationary exercise bike. The wheel attachment for stationary exercise bike is adapted for use in cross-training. Specifically, the wheel attachment for stationary exercise bike is a rotating handle bar that is mounted on the stationary exercise bike. The wheel attachment for stationary exercise bike is mounted on a pivot that allows the wheel attachment for stationary exercise bike to be rotated in a first plane of rotation that is perpendicular to a second plane of rotation that is defined by the rotation of the pedals of the exercise bike. The wheel attachment for stationary exercise bike comprises a pivot, a handle bar, a strut, and a front tire apparatus.

16 Claims, 5 Drawing Sheets

(56) References Cited

U.S. PATENT DOCUMENTS 5,466,203 A * 11/1995 Chen ..... A63B 21/0051 482/57
5,916,067 A * 6/1999 Morasse ..... A63B 69/16 482/61
6,491,606 B1 * 12/2002 Swift ..... A63B 22/0605 482/57
6,659,486 B2 * 12/2003 Eschenbach ..... B62K 3/002 280/221
7,172,532 B2 * 2/2007 Baker ..... A63B 22/0605 403/109.1
7,314,434 B2 * 1/2008 Chen ..... A63B 21/0051 188/164
7,326,151 B2 * 2/2008 Peterson ..... A63B 22/16 482/57
7,364,533 B2 * 4/2008 Baker ..... A63B 22/0605 248/408
7,422,548 B1 9/2008 Teng
7,470,220 B2 * 12/2008 Hernandez ..... A63B 21/012 188/25
7,520,842 B2 * 4/2009 Comair ..... A63B 69/16 482/54
7,604,575 B2 * 10/2009 Papadopoulos ..... A63B 69/16 482/54
7,883,449 B2 2/2011 Wan
8,029,419 B2 * 10/2011 Wan ..... A63B 69/16 482/61
8,162,806 B2 4/2012 Hamilton
8,430,797 B2 * 4/2013 Wan ..... A63B 69/16 482/61
8,585,561 B2 * 11/2013 Watt ..... A63B 21/0051 482/57
8,834,324 B2 * 9/2014 Lull ..... A63B 21/015 482/15
9,327,162 B2 * 5/2016 Huang ..... A63B 22/06
2008/0234112 A1 * 9/2008 Hernandez ..... A63B 21/012 482/63
2010/0069205 A1 * 3/2010 Lee ..... A63B 21/0051 482/63
2010/0234185 A1 * 9/2010 Watt ..... A63B 21/0051 482/8
2010/0323850 A1 * 12/2010 Bingham, Jr. ..... A63B 21/225 482/63
2012/0088637 A1 * 4/2012 Lull ..... A63B 21/015 482/57
2012/0088638 A1 * 4/2012 Lull ..... A63B 21/015 482/57

* cited by examiner

100

WHEEL ATTACHMENT FOR STATIONARY EXERCISE BIKE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of apparatus for physical training, more specifically, particular details of a device that is adapted for use with cardiovascular conditioning equipment.

SUMMARY OF INVENTION

The wheel attachment for stationary exercise bike is an attachment adapted for use with a stationary exercise bike. The wheel attachment for stationary exercise bike is adapted for use in cross-training. Specifically, the wheel attachment for stationary exercise bike is a rotating handle bar that is rotated by the user in order to exercise the upper body while the lower body is exercised using the stationary exercise bike. The wheel attachment for stationary exercise bike forms a handle that is mounted on the stationary bike. The wheel attachment for stationary exercise bike is mounted on a pivot that allows the wheel attachment for stationary exercise bike to be rotated in a first plane of rotation that is perpendicular to a second plane of rotation that is defined by the plane of rotation of the pedals of the exercise bike. The mass of the wheel attachment for stationary exercise bike provides resistance to rotation that enhances the exercise experience. Optionally, a resistance device can be added to the wheel attachment for stationary exercise bike to further increase the resistance of the wheel attachment for stationary exercise bike.

These together with additional objects, features and advantages of the wheel attachment for stationary exercise bike will be readily apparent to those of ordinary skill in the art upon reading the following detailed description of the presently preferred, but nonetheless illustrative, embodiments when taken in conjunction with the accompanying drawings.

In this respect, before explaining the current embodiments of the wheel attachment for stationary exercise bike in detail, it is to be understood that the wheel attachment for stationary exercise bike is not limited in its applications to the details of construction and arrangements of the components set forth in the following description or illustration. Those skilled in the art will appreciate that the concept of this disclosure may be readily utilized as a basis for the design of the other structures, methods, and systems for carrying out the several purposes of the wheel attachment for stationary exercise bike.

It is therefore important that the claims be regarded as including such equivalent construction insofar as they do not depart from the spirit and scope of the wheel attachment for stationary exercise bike. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
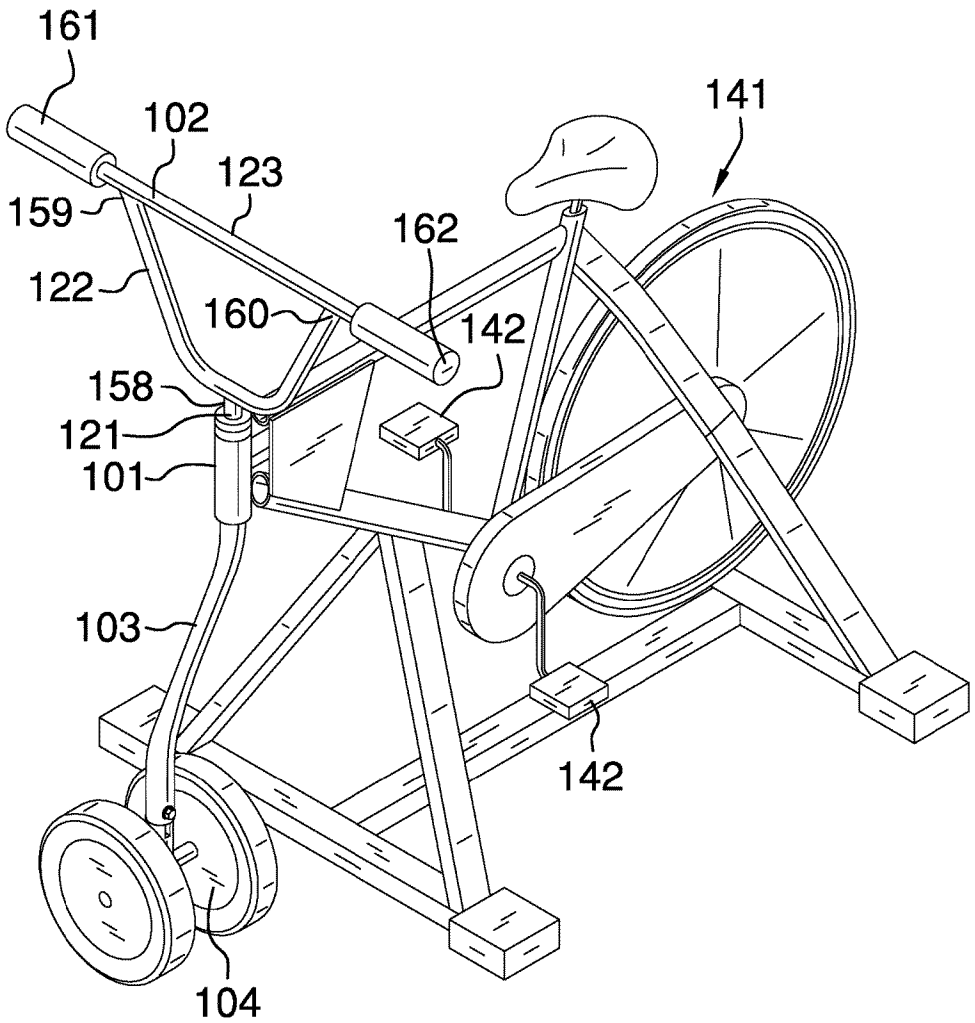
FIG. 1 is a perspective view of an embodiment of the disclosure.
Figure 2:
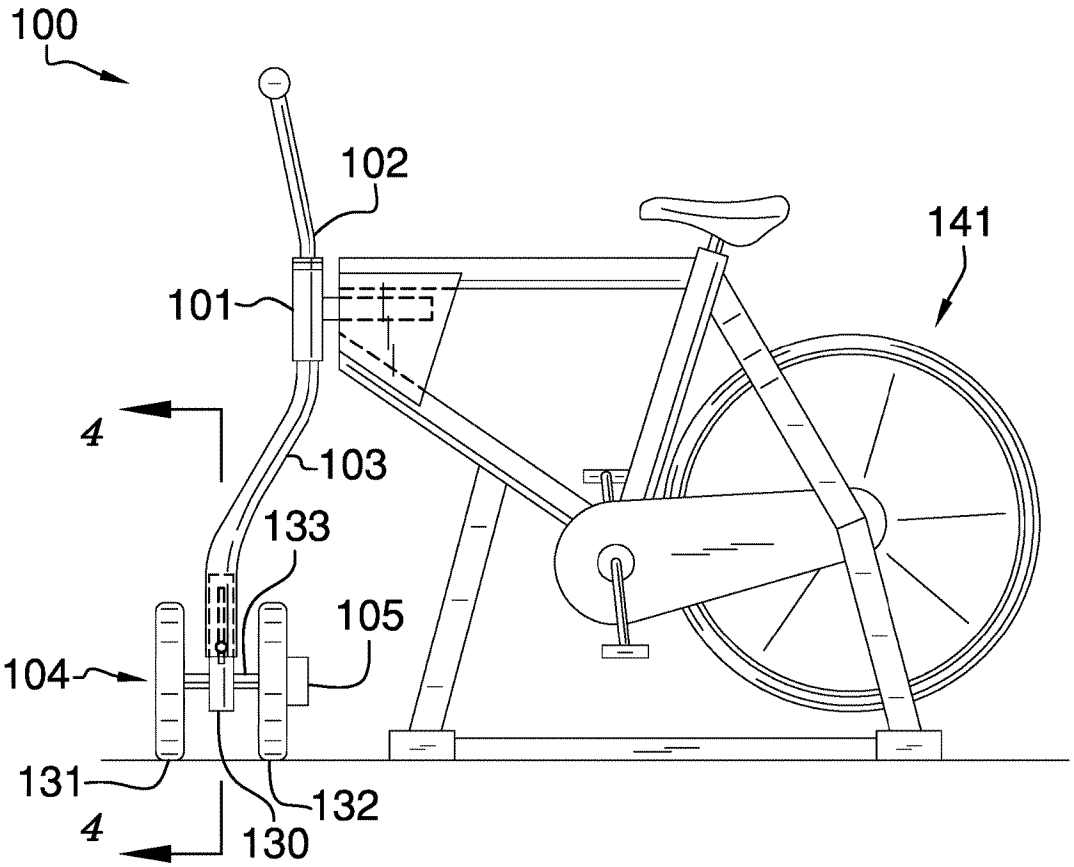
FIG. 2 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5.

The wheel attachment for stationary exercise bike 100 (hereinafter invention) comprises a pivot 101, a handle bar 102, a strut 103, and a front tire apparatus 104. The invention 100 is an attachment adapted for use with a stationary exercise bike 141. The invention 100 is adapted for use in cross-training. Specifically, the invention 100 is a rotating handle bar 102 that is rotated by the user in order to exercise the upper body while the lower body is exercised using the stationary exercise bike 141. The invention 100 forms a handle bar 102 that is mounted on the stationary exercise bike 141. The invention 100 is mounted on a pivot 101 that allows the invention 100 to be rotated in a first plane of rotation 106 that is perpendicular to a second plane of rotation 143 that is defined by the plane of rotation of the pedals 142 of the exercise bike 141. The mass of the invention 100 provides resistance to rotation that enhances the exercise experience. Optionally, a resistance device 105 can be added to the invention 100 to further increase the resistance of the invention 100. The resistance device 105 can be a commercially available friction device or a commercially available magnetic resistance device. In the first potential embodiment of the disclosure, the resistance device 105 is added to the front tire apparatus 104.

The pivot 101 is the portion of the invention 100 that connects the invention 100 to the stationary exercise bike 141. The pivot 101 further comprises a first shaft 111, a second shaft 112, and a receiving port 113. The first shaft 111 is a cylindrical pipe that is further defined with a first end 151, a second end 152, a first inner diameter 171 and a first outer diameter 181. The second shaft 112 is a cylindrical pipe that is further defined with a third end 153, a fourth end 154, a second inner diameter 172 and a second outer diameter 182. The receiving port 113 is a cylindrical pipe that is further defined with a fifth end 155, a sixth end 156, a third inner diameter 173 and a third outer diameter 183. The receiving port 113 is mounted on the stationary exercise bike 141 such that the center axis of the receiving port 113 is parallel to the surface upon which the invention 100 is placed. The span of the third inner diameter 173 is greater that the span of the second outer diameter 182 thereby allowing the fourth end 154 of second shaft 112 to be inserted into the fifth end 155 of the receiving port 113 thus connecting the invention 100 to the stationary exercise bike 141. The third end 153 of the second shaft 112 is attached to the first shaft 111 such that the center axis of the second shaft 112 intersects perpendicularly with the center axis of the first shaft 111. The second shaft 112 is inserted into the receiving port 113 such that the center axis of the second shaft 112 is aligned with the center axis of the receiving port 113.

Figure 3:
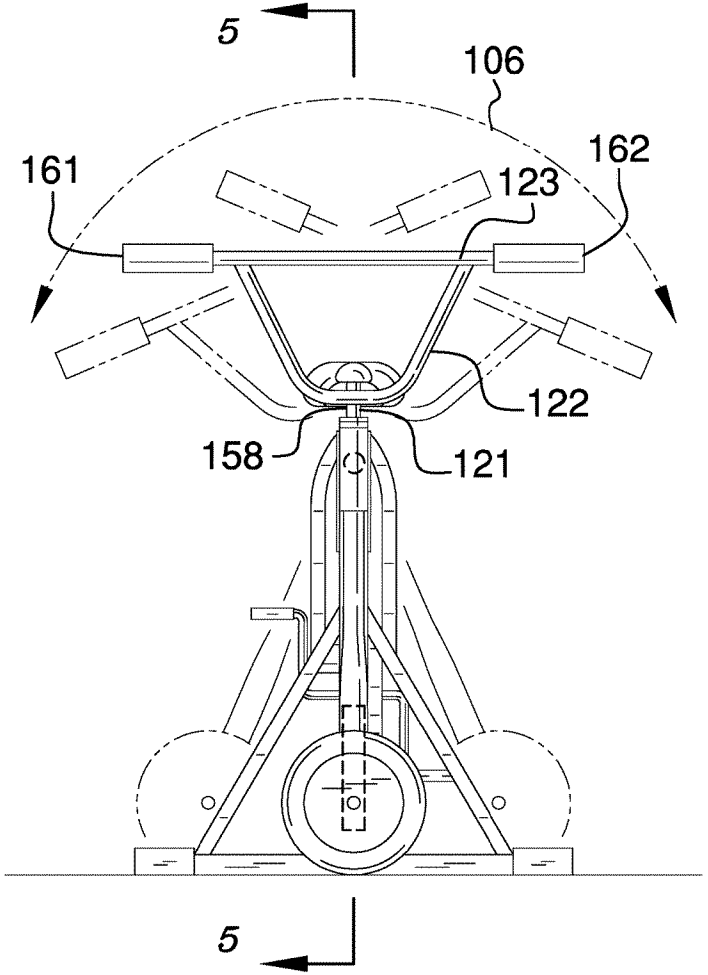
FIG. 3 is a front view of an embodiment of the disclosure.
Figure 4:
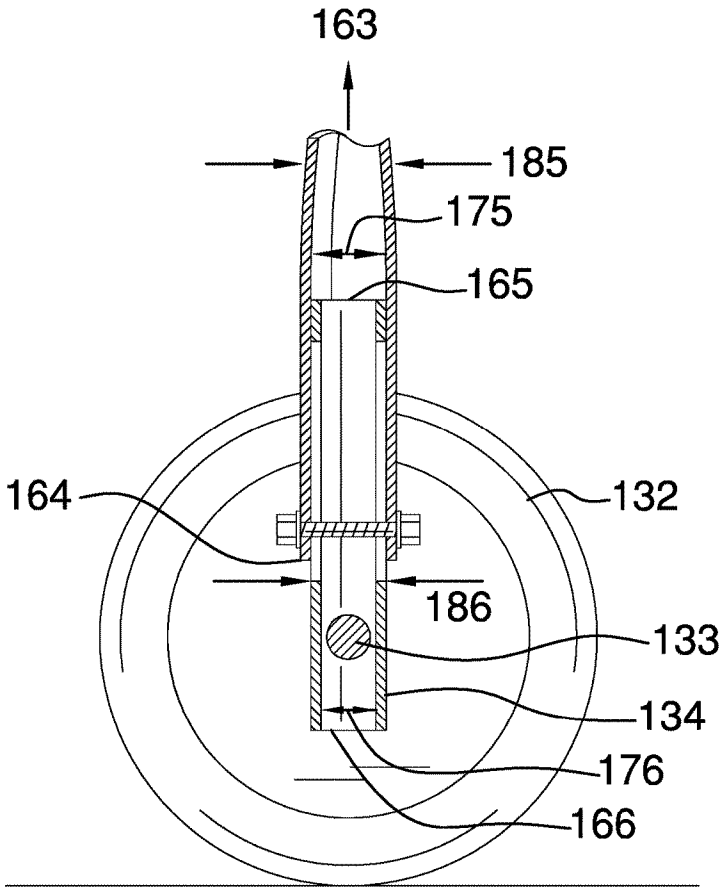
FIG. 4 is a cross-sectional view of an embodiment of the disclosure across 4-4 as shown in FIG. 2.
Figure 5:
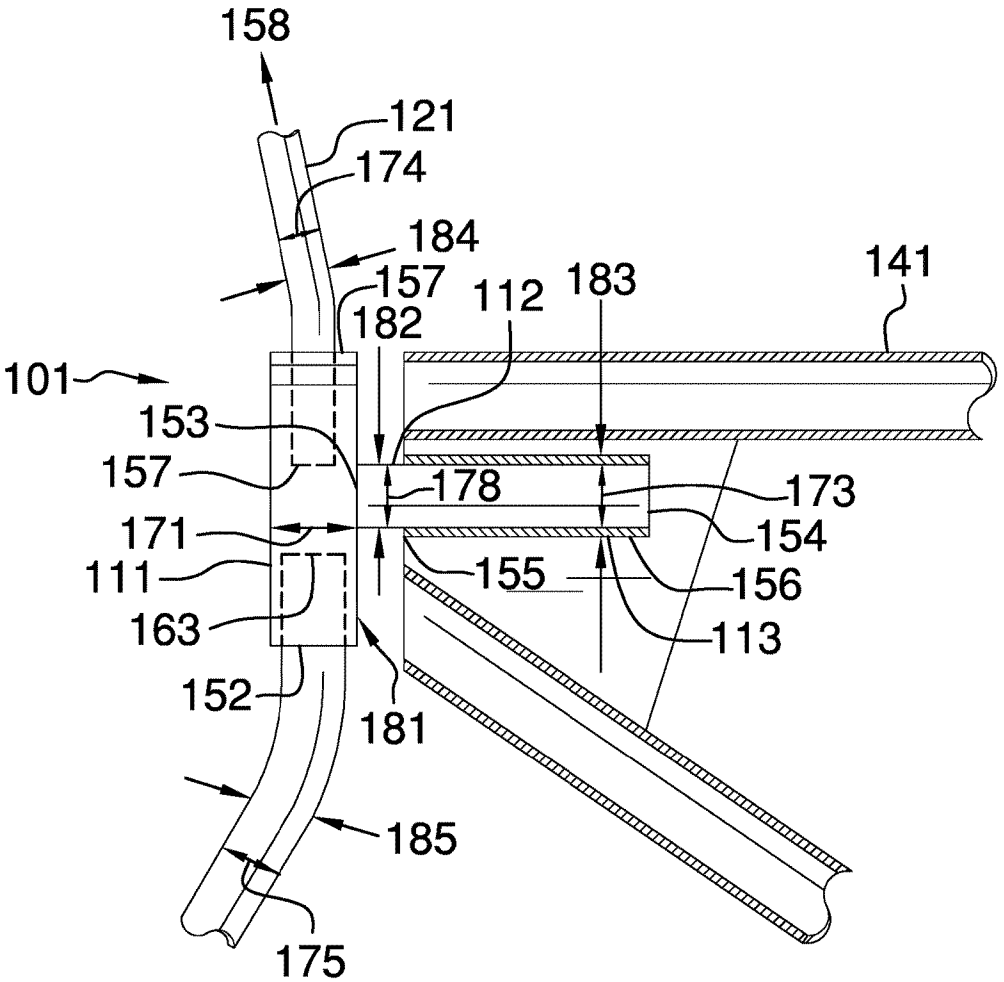
FIG. 5 is a cross-sectional view of an embodiment of the disclosure across 5-5 as shown in FIG. 3.

The handle bar 102 is the portion of the invention 100 that is rotated by the user during exercise. The handle bar 102 further comprises a third shaft 121, a U brace 122, and a cross bar 123. The third shaft 121 is a cylindrical pipe that is further defined with end 157, an eighth end 158, a fourth inner diameter 174 and a fourth outer diameter 184. The U brace 122 is a U shaped cylindrical pipe that is bent into the shape of a U and that is further defined with a ninth end 159 and a tenth end 160. The cross bar 123 is a cylindrical pipe that is further defined with an eleventh end 161 and a twelfth end 162. As shown in FIG. 5, the span of the fourth outer diameter 184 is less than the span of the first inner diameter 171 such that the seventh end 157 of the of the third shaft 121 will fit into the first end 151 of the first shaft 111. As shown in FIGS. 1 and 3, the eighth end 158 of the third shaft 121 attaches to the U brace 122. The ninth end 159 and the tenth end 160 of the U brace 122 attaches to the cross bar 123. As shown most clearly in FIG. 1, the ninth end 159 is attached to the cross bar 123 such that the eleventh end 161 of the cross bar 123 extends past the ninth end 159 of the U brace 122 creating a first projecting region of the cross bar 123 that the user can grip. Similarly, the tenth end 160 is attached to the cross bar 123 such that the twelfth end 162 of the cross bar 123 extends past the tenth end 160 of the U brace 122 creating a second projecting region of the cross bar 123 that the user can grip The front tire apparatus 104 further comprises a first wheel 131, a second wheel 132, an axle 133, and an attachment shaft 134. The first wheel 131, the second wheel 132, and the axle 133 are readily and commercially available components. The attachment shaft 134 is a cylindrical pipe that further comprises fifteenth end 165, a sixteenth end 166, a sixth inner diameter 176 and a sixth outer diameter 186. As shown most clearly in FIG. 4, the first wheel 131 and the second wheel 132 are joined by the axle 133. The axle 133 is inserted through holes formed in the attachment shaft 134. The front tire apparatus 104 is attached to the pivot 101 using the strut 103. The strut 103 is a cylindrical pipe that is further defined with a thirteenth end 163, a fourteenth end 164, a fifth inner diameter 175 and a fifth outer diameter 185. The span of the fifth outer diameter 185 is lesser than the span of the first inner diameter 171 such that the thirteenth end 163 of the strut 103 will fit into the second end 152 of the first shaft 111. The span of the fifth inner diameter 175 is greater than the span of the sixth outer diameter 186 such that the fourteenth end 164 of the strut 103 will fit over the fifteenth end 165 of the attachment shaft 134. During exercise, the front tire apparatus 104 rolls along the surface supporting the invention 100. As most clearly in FIG. 2, when used the optional resistance device 105 is attached to the front tire apparatus 104.

Methods for making the above described attachments are described elsewhere on this disclosure.

To use the invention 100, the user uses the stationary exercise bike 141 as it was designed to be used before modification. The user then grips the eleventh end 161 and the twelfth end 162 of the cross bar 123 and rotates the invention 100 in the first plane of rotation 106 such that the center axis of the second shaft 112 and the center axis of the receiving port 113 are the center of rotation of the invention 100.

All the components described in this disclosure are made of metal. Methods to attach the components described in this disclosure to each other are well known and documented in the mechanical arts. Such methods include, but are not limited to, welding, the use of cotter pins, or the use of commercially available hardware. In the first potential embodiment of the disclosure, the receiving port 113 is welded or brazed directly onto the stationary exercise bike 141. The second shaft 112 is inserted into a bearing that is mounted within the receiving port 113 the receiving port 113 and is held in position by the bearing. The remaining attachments of the first potential embodiment of the disclosure are made with cotter pins. As shown most clearly in FIG. 2, the strut 103 and the third shaft 121 can be bent such that the strut 103 and the third shaft 121 do not form right cylinders. It is anticipated that these deformations from a right cylinder would be made to allow for clearance between the invention 100 and the exercise bike 141.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane or a line within a rotating object that does not move with the rotation of the object.

Cotter Pin: As used in this disclosure, a cotter pin is a detent that comprises a metal pin that is used to hold two objects together.

Cylinder: As used in this disclosure, a cylinder is a geometric structure defined by two identical flat and parallel ends that are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term right cylinder is defined as a cylinder wherein the curved surface perpendicularly intersects with the two identical flat and parallel ends.

Detent: As used in this disclosure, a detent is a device for positioning and holding one mechanical part in relation to another in a manner such that the device can be released by force applied to one or more of the parts.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Pipe: As used in this disclosure, the term pipe is used to describe a rigid hollow cylinder. While pipes that are suitable for use in this disclosure are often used to transport or conveys fluids or gasses, the purpose of the pipes in this disclosure are structural.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An exercise device comprising:

a pivot, a handle bar, a strut, and a front tire apparatus;

wherein the exercise device is adapted for use with a stationary exercise bike;

wherein the exercise device is adapted for use in cross-training;

wherein the exercise device is adapted to exercise the upper body;

wherein the exercise device is mounted on the stationary exercise bike;

wherein the exercise device is mounted via the pivot;

wherein said pivot allows the exercise device to rotate in a first plane of rotation;

wherein said first plane of rotation is perpendicular to a second plane of rotation; wherein said second plane of rotation is defined by the plane of rotation of the pedals of the exercise bike;

wherein the mass of the exercise device provides resistance to rotation of the exercise device;

wherein the pivot attaches the exercise device to the stationary exercise bike;

wherein the pivot further comprises a first shaft, a second shaft, and a receiving port;

wherein the first shaft is a cylindrical pipe that is further defined with a first end, a second end, a first inner diameter and a first outer diameter;

wherein the second shaft is a cylindrical pipe that is further defined with a third end, a fourth end, a second inner diameter and a second outer diameter;

wherein the receiving port is a cylindrical pipe that is further defined with a fifth end, a sixth end, a third inner diameter and a third outer diameter;

wherein the receiving port is mounted on the stationary exercise bike such that the center axis of the receiving port is parallel to the surface upon which the stationary exercise bike is placed;

wherein the span of the third inner diameter is greater that the span of the second outer diameter;

wherein the fourth end of second shaft is inserted into the fifth end of the receiving port;

wherein the second shaft is inserted into the receiving port such that the center axis of the second shaft is aligned with the center axis of the receiving port.

2. The exercise device according to claim 1 wherein the third end of the second shaft is attached to the first shaft such that the center axis of the second shaft intersects perpendicularly with the center axis of the first shaft.

3. The exercise device according to claim 2 wherein the handle bar further comprises a third shaft, a U brace, and a cross bar.

4. The exercise device according to claim 3 wherein the third shaft is a cylindrical pipe that is further defined with a seventh end, an eighth end, a fourth inner diameter and a fourth outer diameter;

wherein the U brace is a U shaped cylindrical pipe that is bent into the shape of a U and that is further defined with a ninth end and a tenth end;

wherein the cross bar is a cylindrical pipe that is further defined with an eleventh end and a twelfth end;

wherein the span of the fourth outer diameter is less than the span of the first inner diameter.

5. The exercise device according to claim 4 wherein the eighth end of the third shaft attaches to the U brace;

wherein the ninth end of the U brace attaches to the cross bar;

wherein the tenth end of the U brace attaches to the cross bar.

6. The exercise device according to claim 5 wherein the ninth end is attached to the cross bar such that the eleventh end of the cross bar extends past the ninth end of the U brace creating a first projecting region of the cross bar;

wherein the tenth end is attached to the cross bar such that the twelfth end of the cross bar extends past the tenth end of the U brace creating a second projecting region of the cross bar.

7. The exercise device according to claim 6 wherein the front tire apparatus further comprises a first wheel, a second wheel, an axle, and an attachment shaft;

wherein the attachment shaft is a cylindrical pipe that further comprises fifteenth end, a sixteenth end, a sixth inner diameter and a sixth outer diameter.

8. The exercise device according to claim 7 wherein the first wheel and the second wheel are joined by the axle.

9. The exercise device according to claim 8 wherein the axle is attached to the attachment shaft.

10. The exercise device according to claim 9 wherein the front tire apparatus is attached to the pivot using the strut.

11. The exercise device according to claim 10 wherein the strut is a cylindrical pipe that is further defined with a thirteenth end, a fourteenth end, a fifth inner diameter and a fifth outer diameter;

wherein the span of the fifth outer diameter is lesser than the span of the first inner diameter;

wherein the span of the fifth inner diameter is greater than the span of the sixth outer diameter.

12. The exercise device according to claim 11 wherein the thirteenth end of the strut inserts into the second end of the first shaft.

13. The exercise device according to claim 12 wherein the fourteenth end of the strut will fit over the fifteenth end of the attachment shaft.

14. The exercise device according to claim 13 wherein the exercise device further comprises a resistance device.

15. The exercise device according to claim 14 wherein the resistance device is selected from the group consisting of a friction device or a magnetic resistance device.

16. The exercise device according to claim 15 wherein the resistance device is attached to the front tire apparatus.

* * * * *